United States Patent [19]

Tapp et al.

[11] Patent Number: 4,565,247

[45] Date of Patent: Jan. 21, 1986

[54] WIRELINE SET TUBING RETRIEVABLE SEAL BORE PACKER APPARATUS

[75] Inventors: William T. Tapp, Yorktown; William M. Roberts, Deer Park, both of Tex.

[73] Assignee: Elder, Inc., Yorktown, Tex.

[21] Appl. No.: 576,820

[22] Filed: Feb. 3, 1984

[51] Int. Cl.[4] ..... E21B 23/00; E21B 23/06

[52] U.S. Cl. ..... 166/123; 166/181; 166/387

[58] Field of Search ..... 166/120, 123, 124, 125, 166/134, 135, 181, 182, 387

[56] References Cited

U.S. PATENT DOCUMENTS

| | | | |
|---|---|---|---|
| 3,552,489 | 1/1971 | Berryman | 166/120 |
| 3,678,998 | 7/1972 | Cockrell | 166/123 |
| 3,746,093 | 7/1973 | Mullins | 166/134 X |
| 4,044,826 | 8/1977 | Crowe | 166/120 |
| 4,289,200 | 9/1981 | Fisher | 166/120 |
| 4,393,929 | 7/1983 | Akkerman | 166/134 |

*Primary Examiner*—Stephen J. Novosad
*Assistant Examiner*—David J. Bagnell
*Attorney, Agent, or Firm*—Cox & Smith Inc.

[57] ABSTRACT

A retrievable subsurface well conduit engaging apparatus having releasable engaging means which are movable outwardly to engage a well conduit and which may be released by up and down movement of an operating means. Locking means maintains the well conduit engaging means in engagement with the well conduit until the operating means is moved upwardly which releases a coupling means from the locking means and allows disengagement of the apparatus.

19 Claims, 14 Drawing Figures

WIRELINE SET TUBING RETRIEVABLE SEAL BORE PACKER APPARATUS

BACKGROUND OF THE INVENTION

In the process of drilling and completion of a well conduit, production of a well conduit, servicing of a well conduit or abandonment of a well conduit, many different tools have been developed to provide a seal in the annulus between one conduit and another such as between the well bore and casing, and well production tubing or some similar work conduit. Some of these tools provide a means of securing the seal means from upward or downward movement induced by pressure differentials acting upon the seal and/or loads imposed by movement of the tubing string. In as many such tools it is required that the tool provide within its structure a means of releasing both the seal means and anchoring means for retrieval of the tool with minimal effort.

It is known in prior art to provide a retrievable well packer. These devices may be run and set in the desired location within the well bore by attachment to a tubing string or wireline. When a tubing string is used, the packer may be actuated to form a seal and secure the packer to the casing by using hydraulic pressure in the tubing, hydrostatic pressure in the well, or a combination of both, and also mechanically by the weight of the tubing string or tension applied through use of a hoisting mechanism on the surface.

In the case where a packer is run to setting depth on a wireline, the setting force required for establishment of the seal and securing the packer to the well casing is provided by a wireline setting tool and a releasing adapter.

Some packers and more specifically those designed to be run and set on wireline are of a free standing seal bore type or more commonly called retainer production packer in that they are capable of maintaining their seal and securing means against the well casing without the aid of the tubing string. A seal bore is incorporated by means of the internal bore of the packer for placement of a tubing mounted sealing assembly. The tubing mounted sealing assembly is capable of traveling upwardly and downwardly within the packer bore while maintaining the annular seal and also provides for retrieval of the tubing string and tubing seal assembly without recovery of the packer.

The retainer type production packer places a restriction within the well bore. To remove this restriction for unrestricted passage of equipment below the setting points of the retainer production packer requires the drilling up of the retainer production packer if it is the permanent type, or removal with a releasing tool, if it is of the retrievable type, which is run in the well on either a tubing string or wireline attached to the packer and then, through manipulation of the running-in means, the retainer production packer is released from its sealed and secured position and may then be recovered from the well.

In the past, the releasing means within the packer which allowed the retainer production packer to be released from its seal to the casing and from its secure position in relation to vertical movement within the well bore has tended to fail and release the tool from its secured position under high pressure differential loads.

An example of such a retrievable retainer production that is operated by a wireline setting tool is shown in U.S. Pat. No. 3,678,998 issued to D. W. Cockrell et al on July 24, 1972. This patent disclosure is incorporated herein by this specific reference thereto. The invention is distinctively different from this patent in its structure and operation and has several advantages over the above patent.

One advantage is that it is common to use the packer of the invention and other such retrievable packers such as shown in the above identified patent in combination with a seal assembly at the bottom of the production tubing. If, when a seal assembly is used in connection with the Cockrell et al patent, the seal assembly seizes in the seal bore of the packer, you cannot recover the packer as with the instant invention. Another advantage is of the instant invention is that it permits placement of temporary plugging devices and restrictive connected devices on the bottom of the packer body and still maintains the ability to release the packer. The design of the releasing mechanism is such that it allows several additional benefits to the overall improvement of this type of downhole tool. These improvements allow for a larger inside diameter seal bore, an improvement in the pressure holding capability of such tools, and isolation of the releasing mechanism from produced well fluids. Also, the releasing mechanism is not subjected to tension forces tending to over-stress the releasable lock when subjected to high differential pressure loads.

An object of the patent is to provide a well packer or engaging apparatus which can be released from its set, sealed, and secured position in a well bore when the packer bore is intentionally or inadvertently restricted by placement of seal assemblies, temporary plugging devices, or any such device that would prevent passage through the packer body. Another object of the invention is to provide a releasing mechanism that is not subjected to tension load failure when high fluid pressures are placed to the internal bore of the packer with the bottom of the packer plugged or when high fluid pressure are subjected to the bottom of the packer which tends to move the packer up the well bore in relation to its secure position. Another objective is to isolate the releasing mechanism from the produced fluid flow path to protect the releasing mechanism from corrosion and produced undissolved solid materials that could negate its desired operation.

BRIEF DECRIPTION OF THE DRAWINGS

FIGS. 1*a*, 1*b*, 1*c*, and 1d are partial cross sectional views of the apparatus of the invention in its running-in position.

FIGS. 2*a*, 2*b*, 2*c*, and 2*d* are partial cross sectional views showing the apparatus of the invention set in a well casing.

FIGS. 3*a*, 3*b*, 3*c*, and 3*d* are partial cross sectional views showing the apparatus of the invention after it is released from its secured or set position, as shown in FIGS. 2*a*, 2*b*, 2*c*, and 2*d*, for removal from the well bore.

SUMMARY OF THE INVENTION

Figure 1A:
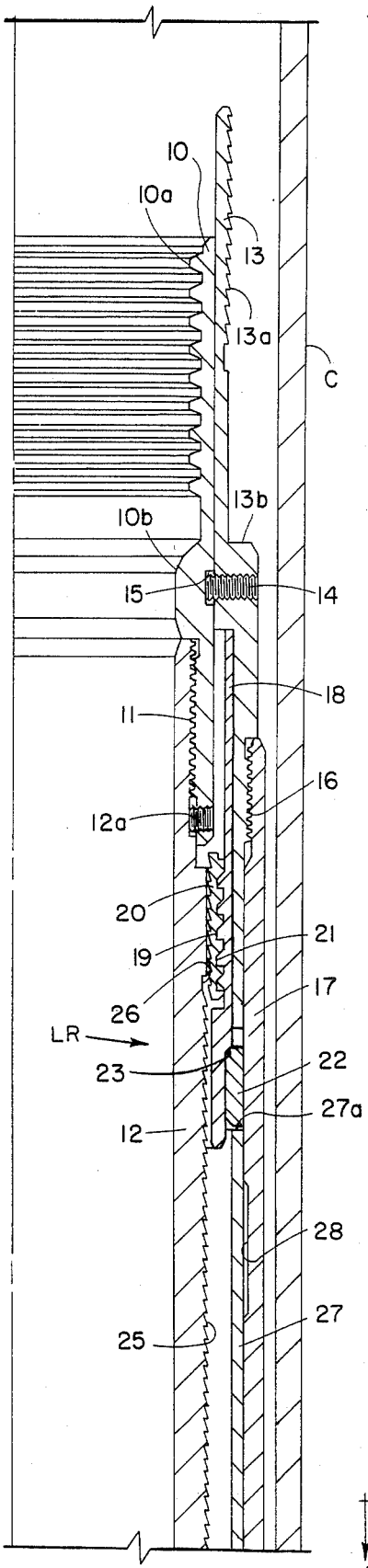

The invention relates to a releasing mechanism and method for a subsurface well conduit engaging apparatus. The apparatus includes an elongated support means for running into a well conduit with engaging means such as slip means and/or packing elements mounted thereon for moving outwardly to engage the well conduit to secure and/or seal the apparatus in the well conduit. An operating means on the outside of the support means is connected to the engaging means to move it outwardly to its engaging position when the operating means is activated by a setting tool means whereby a lock means maintains the engaging means in their engaging position. The operating means has a coupling or releasing means which allows release of the engaging means so the tool can be removed from the well conduit. The coupling or releasing means includes a locking sleeve slidably mounted on the support means and a plurality of coupling or releasing segments which are released upon upward movement of the operating means to release the operating means from the locking means.

BRIEF DESCRIPTION OF THE PREFERRED EMBODIMENT

This tool in accordance with this invention includes a cylindrical body or mandrel comprising an elongated support means around which a packing unit is mounted which will expand into sealing engagement with a well conduit or the like when a compressive force is applied by movement of the body relative to an operating means, having an upper locking mechanism, and a lower securing or engaging mechanism, both of which are also arranged around the periphery of the cylindrical body. The locking mechanism cooperates between the support means and a concentric number of the operating means to directly capture the relative movement and thereby maintain the setting of the sealing and securing means.

The above described tool is normally run into a well bore and set, sealed, and secured to the casing using an electric line actuated running tool. However, it may also be run into a well bore and set, sealed and secured to the casing using a hydraulic powered setting tool or a setting tool utilizing atmospheric pressure trapped in a closed chamber and acted upon by well hydrostatic pressure through a slidable connection. All of the above setting devices are known and in normal use for setting retainer type packers. A setting adapter is used that will mate the specific setting device to a given retainer packer allowing the setting force to be transmitted from the setting device to the retainer packer and then execute a release sequence to disengage the setting device from the retainer packer.

The setting and releasing system has a coupling means which includes a plurality of segments that are trapped by an outer release sleeve, above the fishing neck and below by a setting sleeve, that provides the upper abutment of the elastomer seal means. The entire above-described assembly moves as a single unit during the setting sequence. During the release sequence however, the fishing neck and release sleeve are lifted upwardly in relation to the cylindrical body and locking means, allowing the segments to move radially outwardly and release from their engagement with the locking means. Further upward movement of the fishing neck will release the compressive force stored in the elastomer seal means and release the securing means allowing the tool to be removed from the well bore.

The wireline set tubing retrievable seal bore packer apparatus A of the invention is shown in FIGS. 1*a*–1*d*, 2*a*–2*d*, and 3*a*–3*d*. FIGS. 1*a*, 1*b*, 1*c* and 1*d* show the apparatus in its running in position for insertion in a well conduit. FIGS. 2*a*, 2*b*, 2*c* and 2*d* show the apparatus in its set position with packers and slips engaging the well conduit to lock it within the well conduit. FIGS. 3*a*, 3*b*, 3*c* and 3*d* show the apparatus after it is released for removal from the well conduit.

The apparatus A includes a cylindrical top sub 10 for connecting to a wireline running-in tool of conventional type (not shown). The top sub 10 includes a box connector 10*a* for connection with the running in string. Top sub 10 includes a locating shoulder 10*b* for landing a locating means for sealing off the production tubing. The top sub 10 is connected to an elongated support means, having a cylindrical body or mandrel 12, by thread means 11. One or more set screws 12*a* engage the body 10 to prevent loosening of thread means 11. The body 12 includes a cylindrical inside sealing surface 12*b*, see FIG. 1*c*, for sealing engagement with a tubing sealing assembly.

An operating means comprising fishing neck means 13 is provided at the top of the tool including fishing thread means 13*a*. The fishing neck means 13, which is slidably connected to the top sub 10, is held in the running-in position by one or more frangible devices or shear screws 14 which may be four in number and which engage a circumferential groove 15 in the top sub 10. The operating means comprises a second means including release sleeve 17 which is connected to the fishing neck means 13 by thread means 16 so that it is slidable therewith. The release sleeve 17 includes an engaging surface 17*a* at its lower end, FIG. 1*b*, as explained hereinafter.

Figure 4:
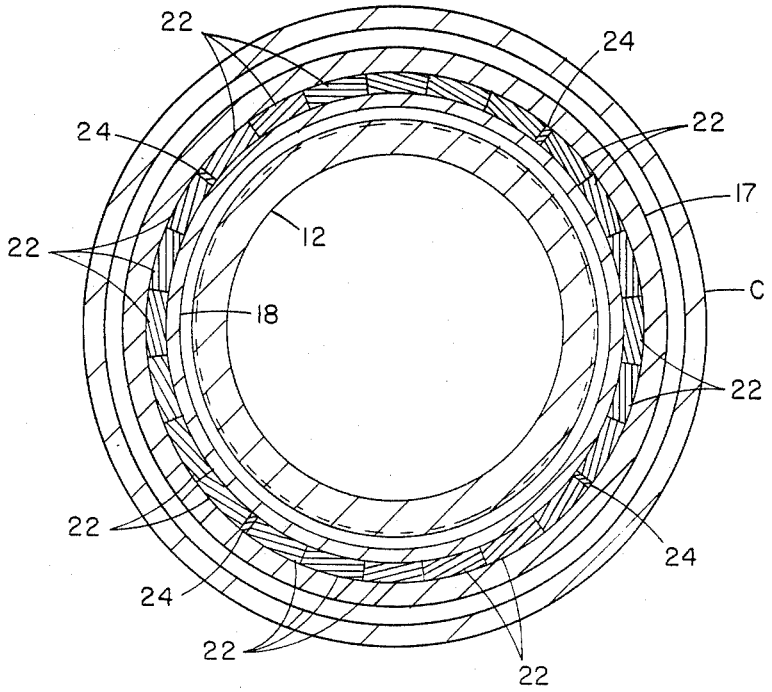
FIG. 4 is a cross sectional view showing the release segments in their locked running-in position.
Figure 5:
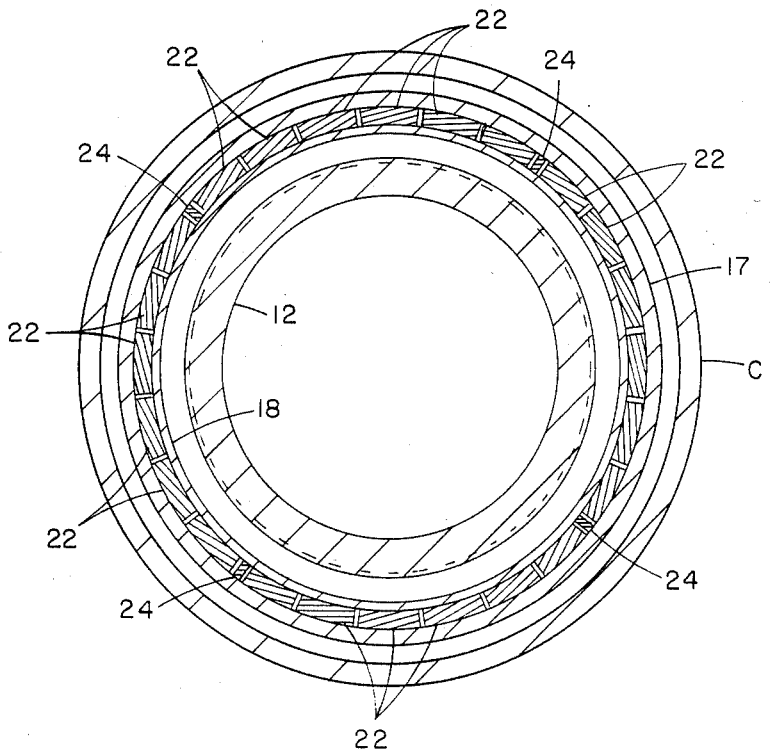
FIG. 5 is a cross sectional view showing the release segments in their released position for removing the tool after it has been set and released.

A locking means comprising lock ring retainer 18 is mounted between the fishing neck means 13, top sub 10, and body 12. The lock ring retainer 18 is connected to a lock ring 20 of the locking means through right hand buttress thread 19 on the lock ring retainer 18 which engages a right hand buttress thread 21 on the lock ring 20. A plurality of circumferentially spaced coupling or release segments 22, FIG. 1*a*, 4 and 5 extend circumferentially around the lock ring retainer 18 and engage a shoulder 23 on the lock ring retainer 18. A plurality of release segment spacers 24, FIGS. 4 and 5, space the release segments around the lock ring retainer 18. A right hand buttress thread 25 is formed on the outer surface of the body 12. A mating right hand buttress thread 26 is formed on the lock ring 20 so that the lock ring 20 will ratchet downwardly relative to the body 12 and maintain its position after ratcheting down due to the engagement of the buttress threads.

Figure 3B:
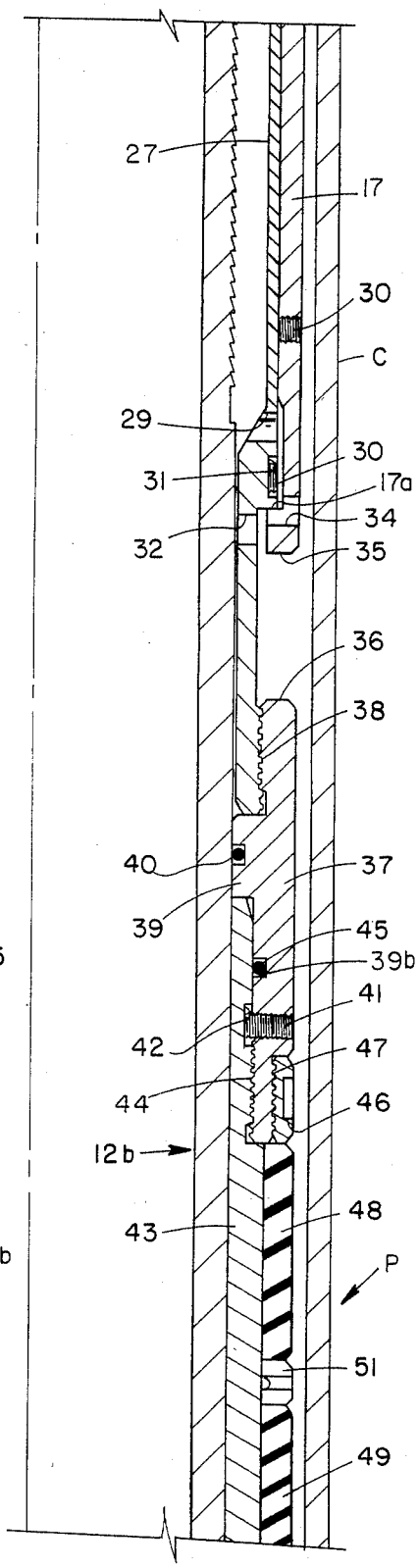

The operating means further comprises a first means including cylindrical setting sleeve 27 which is positioned between the body 12 and release sleeve 17. The release sleeve 17 and setting sleeve 27 telescope relative to each other via their lost motion connection. The setting sleeve 27 includes an engaging surface 27*a*, FIG. 1*b*, providing a lost motion connection and which engages the surface 17*a* of the release sleeve 17 as shown in FIG. 3*b* after the tool is disengaged from the casing C. A circumferential groove 28, FIG. 1*a*, is formed in the release sleeve 17 for receiving the coupling means comprising release segments 22 and release segment spacers 24 shown in FIG. 5. An aperture 29 is provided in the setting sleeve 27 for equalizing the pressure on both sides of the sleeve. A shear screw 30 is mounted with the release sleeve 17 and there are four such screws circumferentially equally spaced to engage an annular groove 31 in the setting sleeve 27. A plurality of circumferentially spaced apertures 32 provide pressure equalization. Another plurality of circumferentially spaced apertures 34 likewise provide pressure equalization.

Figure 2A:
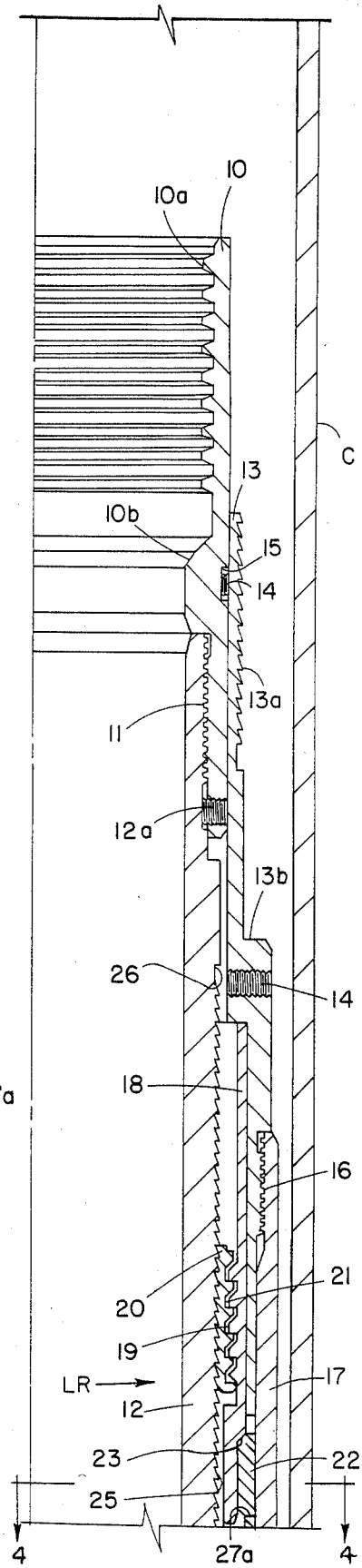
Figure 3A:
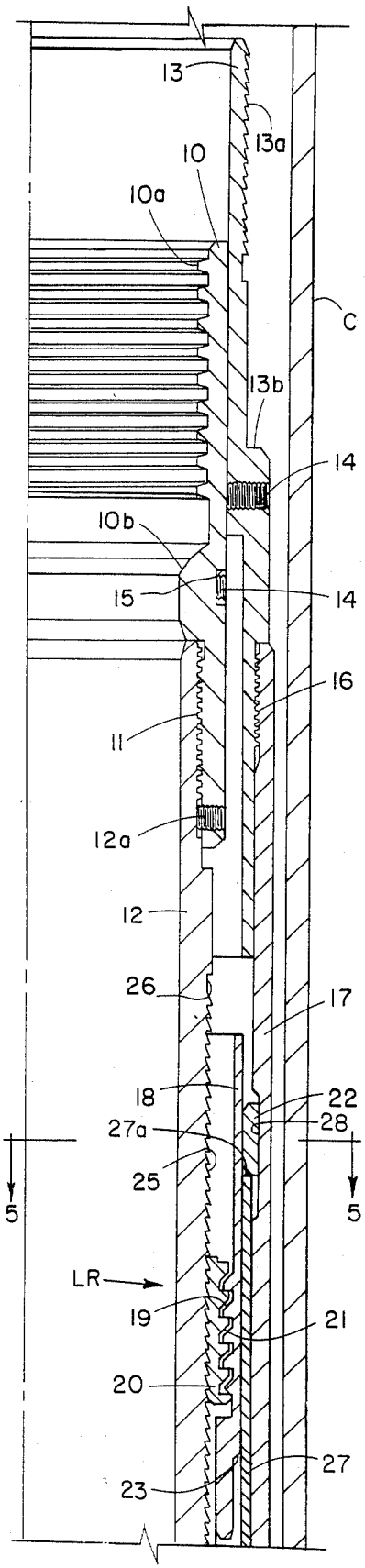
Figure 2B:
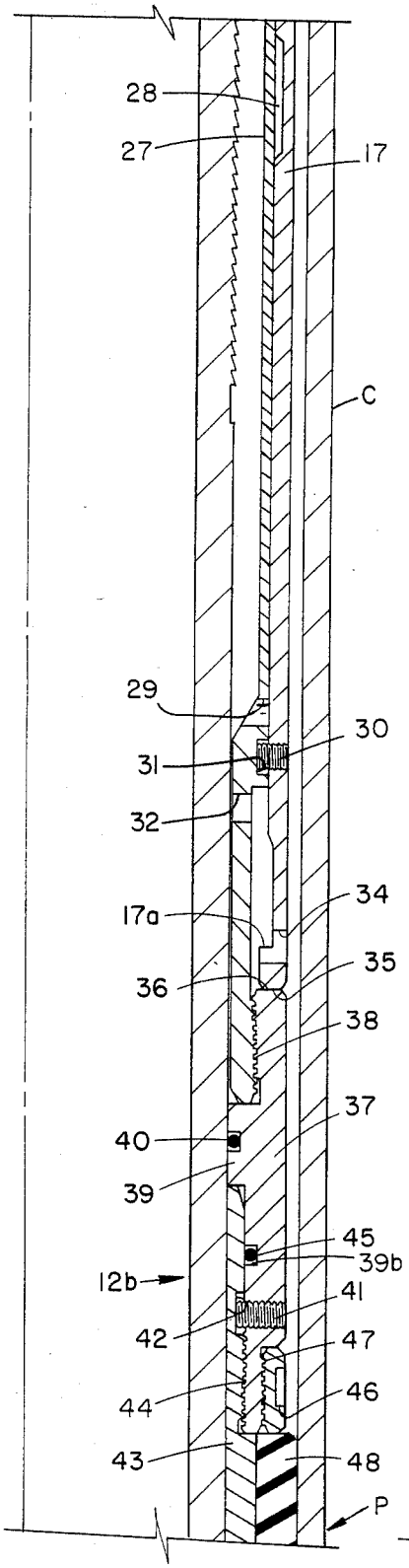

An engaging means comprising packing unit retainer 37 is mounted on the outer periphery of the body 12 and is connected to the setting sleeve 27 by thread means 38. End surface 35 on the release sleeve 17 may engage the end surface 36 on the packing unit retainer 37 as shown in FIG. 2*b*. The annular groove 31 is wider than the diameter of shear screws 30 to allow engagement without putting pressure on the setting screw until it is desired to release the apparatus from its set position.

The cylindrical packing unit retainer 37 includes an O-ring flange 39 which includes an annular groove 39*b* for receiving O-ring 40 which forms a seal between the packing unit retainer 37 and the outer surface of the body 12. A cylindrical packing mandrel 43 is connected to the packing unit retainer 37 by a thread means 44. Two circumferentially spaced set screws 41, one of which is shown, extend into groove 42 in the packing mandrel 43 to prevent loosening of the thread means 44. An O-ring 45 is positioned in an annular groove 39*b* of the packing unit retainer 37 to provide a seal.

Figure 1B:
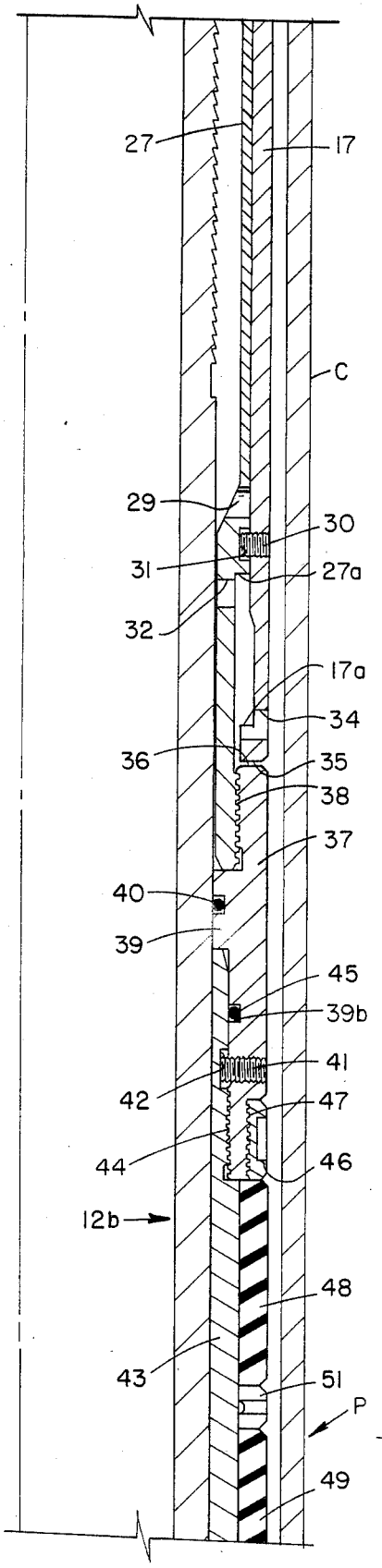

A gage ring 46, FIG. 1*b*, is connected to the packing unit retainer 37 by thread means 47. The engaging means further comprises a plurality of elastomer seal means or annular packing elements 48, 49, and 50, FIGS. 1*b* and 1*c*, which are positioned on the outer surface of packing mandrel 43. Spacer means 51 and 52 separate the packing elements 48, 49 and 50.

Figure 1C:
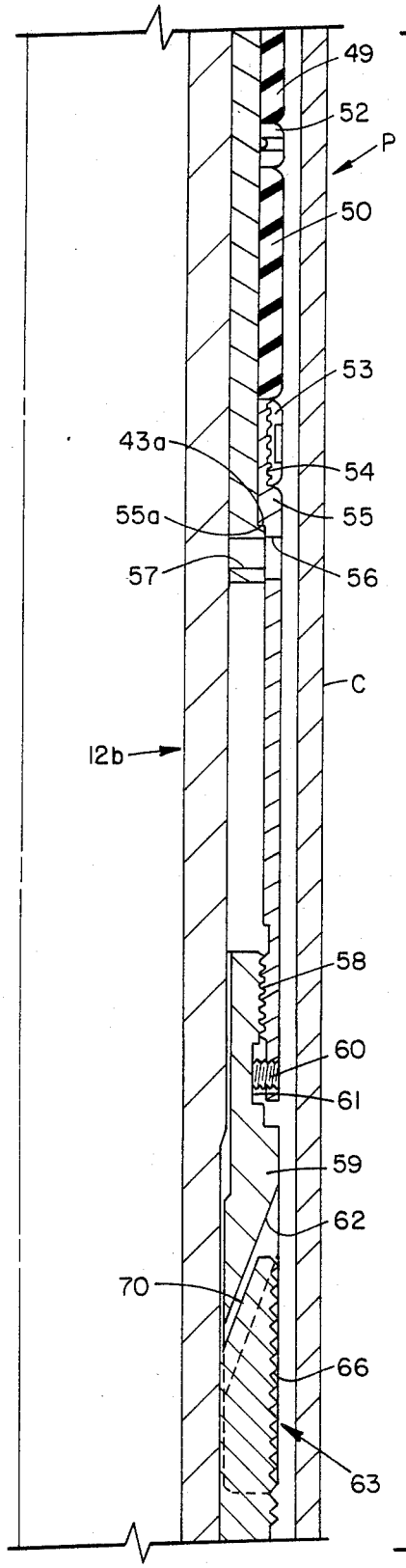

A gage ring 53, FIG. 1*c*, is mounted upon compression sleeve 55 and connected thereto by thread means 54. A plurality of circumferentially spaced apertures 56, four of which are provided, extend through the compression sleeve 55 to provide pressure equalization. Similarly a plurality of circumferentially spaced apertures 57, four of which are provided, extend through the packing mandrel 43 to provide pressure equalization. These apertures serve another function which is to allow the insertion of a spanner wrench to facilitate assembly of the packing mandrel 43 into the packing unit retainer 37. When the tool is in its running position as shown in FIGS. 1*a*, 1*b*, 1*c* and 1*d* the upset shoulder 43*a*, FIG. 1*c*, on the packing mandrel 43 engages the upset shoulder 55*a* on the compression sleeve 55.

An upper expander means 59 is connected to the compression sleeve 55 by thread means 58. Adjusting set screw 60 extends into an annular adjusting groove 61 in the upper expander 59. The slack in the tool is taken up by the thread means 58 and the adjusting set screw 60 is then tightened to prevent further loosening or tightening of the thread means 58. The upper expander means 59 includes a inclined plane or ramp surface 62.

The engaging means further comprises upper slip means 63 and lower slip means 64 each including a plurality of circumferentially spaced slips which are operatively connected by slip ring means 65. The upper slip means 63 includes slips with engaging means or teeth 66 and the lower slip means 64 includes slips with engaging or teeth means 67. Interconnecting means 68 and 69 connect the upper and lower slip means 63 and 64 with the slip ring means respectively. An inclined plane or ramp surface 70 on the upper slip means 63 engages the inclined plane surface 62 on the upper expander means 59. A set screw 71 is positioned between adjacent lower slips to lock the lower expander means with the body 12. The lower expander means 73 includes an inclined plane surface or ramp 74 which engages and inclined plane surface or ramp 75 on the lower expander means. A groove 76 in the lower expander means 73 receives an O-ring 77 which provides a seal between the lower expander means and the body 12. The lower expander means 73 is connected to the body 12 by a thread means 78.

A bottom sub 79 is connected to the lower expander means 73 by a thread means 80. An annular groove 82 is formed in the lower expander means 73 for receiving a plurality of set screws 81, four of which are provided circumferentially spaced around the bottom sub 79 to prevent loosening of the thread means 80. A groove 83 is provided in the lower expander means 73 for receiving an O-ring 84 which provides a seal between the lower expander means 73 and the bottom sub 79.

The operation and method of the device is as follows. A running adapter device (not shown) and previously discussed setting tool is connected to the top sub 10. The running device enables insertion of the apparatus A into the well conduit and lowering of it to a desired location. After the apparatus A is lowered to its desired location, the packing means P is set with the inner cylindrical surface of the well conduit or casing C. The setting operation is achieved as follows. A downward force is applied by the setting tool to the operating means to move the shoulder 13*b* and the fishing neck 13 while the top sub 10 is held relatively stationary. This causes the fishing neck 13 of the operating means to be moved downwardly after shearing of the plurality of the shear pins 14 as shown in FIG. 2*a*. Downward movement of the fishing neck 13 will also provide downward movement of the locking releasable coupling mechanism LR as also shown in FIG. 2*a*. Downward movement of the fishing neck means 13 will also provide downward movement of the release sleeve 17 of the operating means until the surfaces 35 and 36 engage. Since the release sleeve 17 engages the packing unit retainer 37 of the engaging means downward movement of the release sleeve 17 will also cause downward movement of the packing sleeve 37 as shown in FIG. 2*b* to operate the appartus.

Figure 2C:
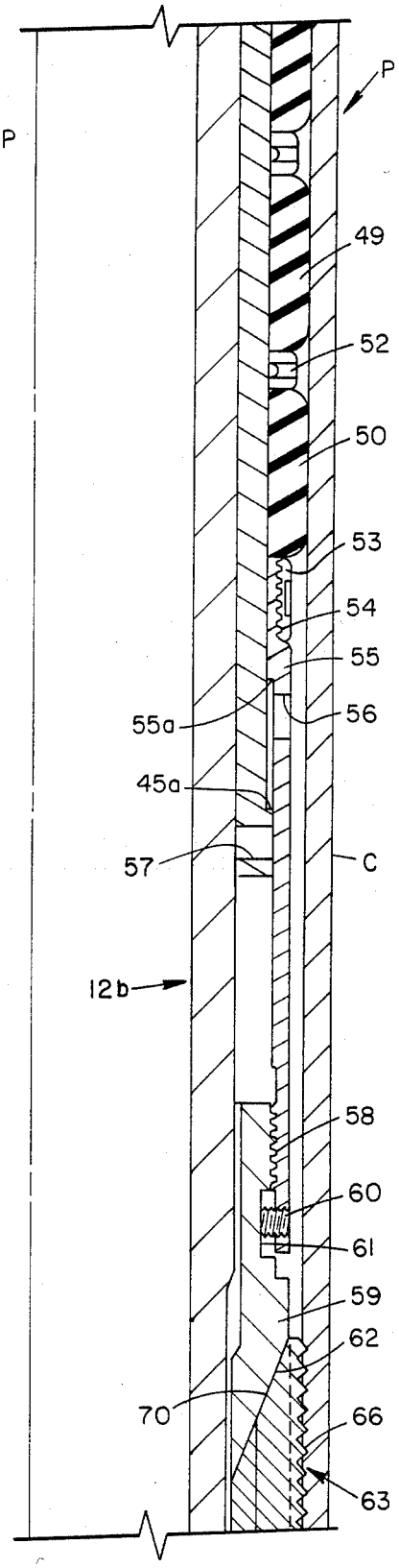
Figure 3C:
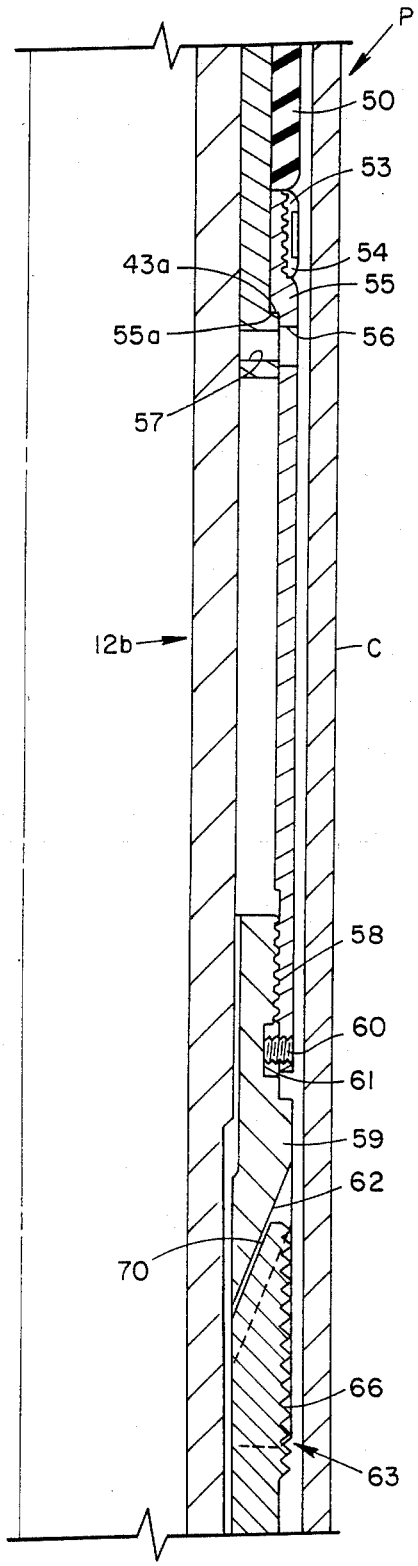
Figure 1D:
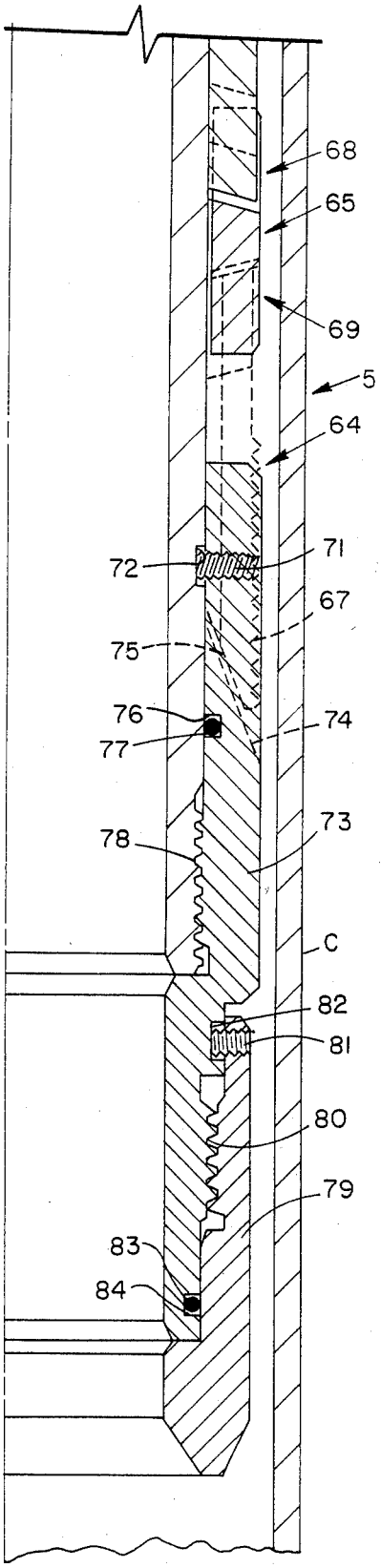
Figure 2D:
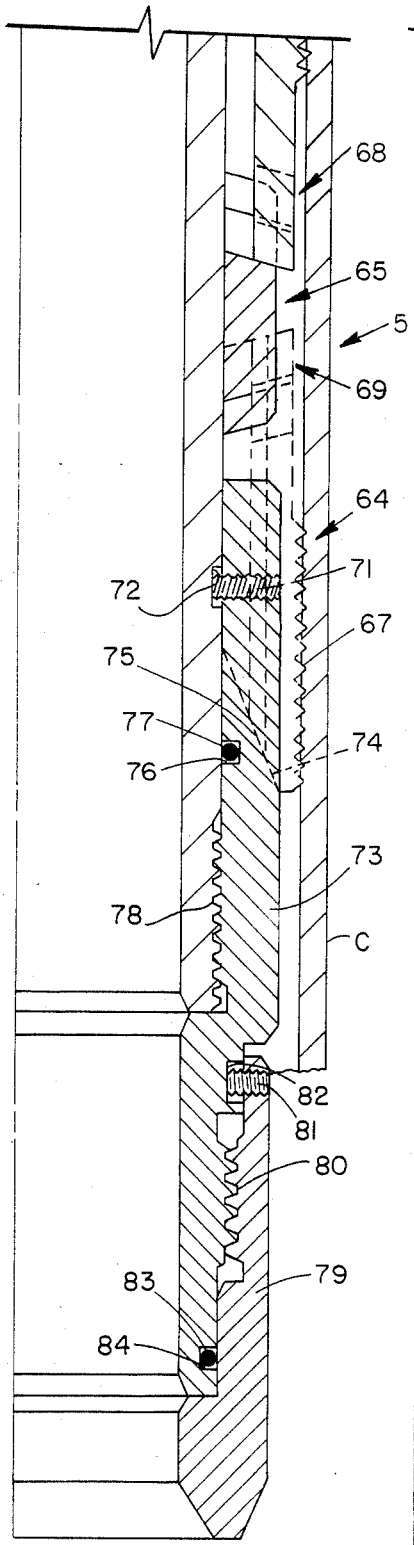
Figure 3D:
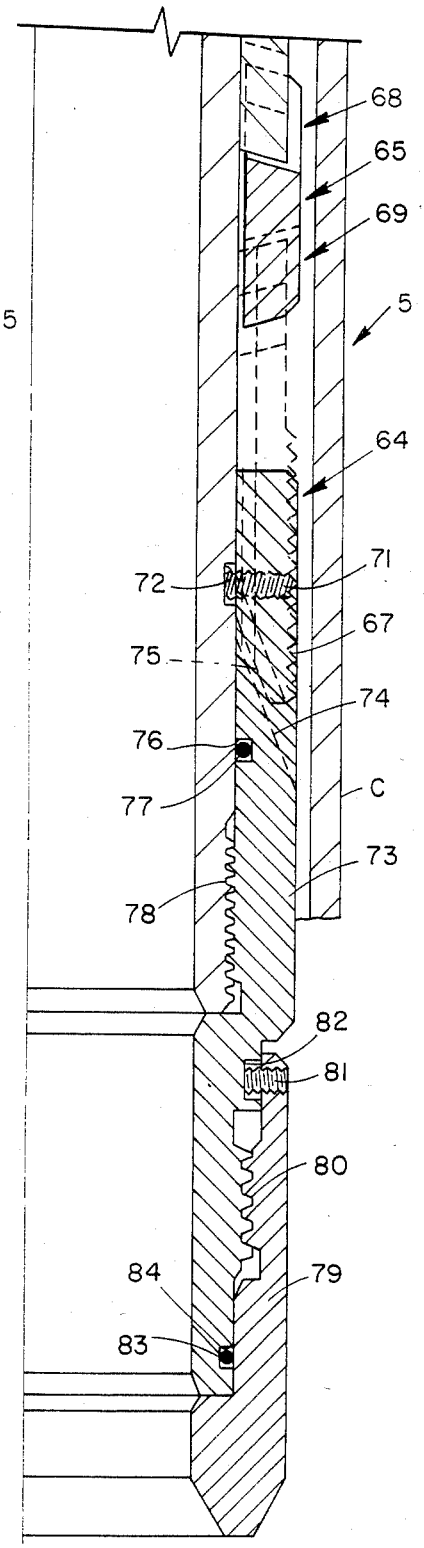

The packing unit retainer 37 of the engaging means is connected to the packing mandrel 43 so that they will move downwardly together. Because substantial force is required to expand the packing elements 48, 49 and 50 of the engaging means, the downward force will be transferred to the compression sleeve 55 which will in turn provide downward force to the upper expander 59. The inclined surface 62 on the upper expander which engages the inclined surface 70 on the upper slip means of the engging means will provide downward movement of the upper slip 63 means. The lower slip means 64 of the engaging means, because of the engagement of the inclined surfaces 74 and 75 and the effect of gravity, will tend to move outwardly first until it engages the inner wall of the casing as shown in FIG. 2*d*. Continued downward force will also cause outward radial movement of the slip means 63 of the engaging means until it similarly engages the inner surface of the casing and the teeth 66 and 67 of the slip means dig into the inner wall of the casing C to lock the apparatus in position. Continued downward force will then expand the packing elements 48, 49 and 50 into sealing engagement with the inner surface of the casing C as shown in FIG. 2*c*. The tool is held in its set position by the locking means comprising lock ring 20 which is ratcheted downward through threads 25 and 26. The tool will remain in its set position allowing disengagement of the setting tool and running adapter.

When it is desired to release the apparatus from the casing C a releasing adaptor is run into the well conduit and connected with the fishing neck 13 of the operating means. An upward force is applied to the fishing neck which will result in shearing of the shear pins 30. Continued upward movement of the fishing neck due to the upward force will move the releasing sleeve 17 upward after the shear pins 30 are sheared until the lost motion is taken up and engaging surface 17*a* engages the engaging surface 27*a* on the setting sleeve 27. The annular groove 28 is positioned opposite the release segments 22 including the release segment spacers 24 which move radially into the annular groove 28 and past the biased shoulder 23 so that they may be moved upwardly along the outer periphery of the lock ring retainer 18.

The upward movement of the release sleeve 17 of the operating means, permits release of the force on the packing unit retainer 37 which in turn moves the packing mandrel 43 and the upper expander means 59 of the engaging means upwardly. This results in retraction of the upper and lower slip means 63 and 64 of the engaging means to release the tool from the well conduit. It is then possible to lift the tool out of the well conduit.

We claim:

1. A retrievable subsurface well conduit engaging apparatus comprising:

an elongated support means for running into a well conduit to a selected elevation within the well conduit;

engaging means mounted on said support means and movable outwardly to engage the inner wall of the well conduit for securement of the apparatus in the well conduit from vertical movement therein and from movement inwardly away from said engagement to release the apparatus from said securement;

operating means having first and second means operatively connected to said engaging means and for coupling with an actuating device for selectively moving said engaging means to its outward secured position and to its inward release position upon vertical movement of the operating means;

locking means connected between said elongated support means and the first means of said operating means to maintain said engaging means in its outward secured position; and non-threaded coupling means connecting the second means of said operating means to said locking means operable to release said operating means from said locking means upon vertical, non-rotating movement of the first means of said operating means, said coupling means being provided with means operable to transmit the vertical forces exerted against the second means of said operating means to said locking means so that said vertical forces are not exerted against the first member of said operating means, thereby facilitating the release of the apparatus from the engaging position.

2. The apparatus as set forth in claim 1, wherein:

said first and second means comprise telescoping sleeves.

3. The apparatus as set forth in claim 1, wherein:

said first and second means are secured from relative movement by a frangible means.

4. The apparatus as set forth in claim 1, wherein:

the coupling means includes a plurality of release segments.

5. The apparatus as set forth in claim 4, wherein:

the plurality of release segments are radially movable to release them from the locking means.

6. The apparatus as set forth in claim 1, wherein:

the first and second means are connected by a lost motion connector.

7. The apparatus as set forth in claim 1, wherein:

the locking means includes butress thread means.

8. The apparatus as set forth in claim 1, wherein:

the engaging means includes packing means which form a seal with the inner wall of the well conduit.

9. The apparatus as set forth in claim 1, wherein:

the engaging means includes slip means which secure the apparatus with the inner wall of the well conduit.

10. A retrievable subsurface well conduit engaging apparatus comprising:

an elongated support means running into a well conduit to a selected depth;

engaging means mounted on said support means operable to releasably engage the inner wall of said well conduit to prevent vertical movement therein;

operating means having first and second members operatively connected to said engaging means, said operating means being connectible with an actuating device for selectively engaging and releasing said engaging means from the inner wall of said well conduit;

locking means positioned between the first member of said operating means and said support means operable to prevent vertical movement of said operating means when said engaging means engages the inner wall of said well conduit, said locking means being selectively shiftable to a position between the second member of said operating means and said support means; and coupling means operatively connecting the first member of said operating means to said locking means for releasing said operating means upon vertical, non-rotating movement of the first member of said operating means.

11. The apparatus as set forth in claim 10, wherein:

the first and second members of said operating means comprise telescoping sleeves.

12. The apparatus as set forth in claim 10, wherein:

the first and second members of said operating means are secured from relative movement by a frangible means when said engaging means engages the inner wall of said well conduit.

13. The apparatus as set forth in claim 10, wherein:

the coupling means includes a plurality of release segments.

14. The apparatus as set forth in claim 13, wherein:

said release segments are radially moveable to release them from the locking means.

15. The apparatus as set forth in claim 10, wherein:

the first and second members of said operating means are connected by a lost motion connector.

16. The apparatus as set forth in claim 10, wherein:

said locking means includes buttress thread means.

17. The apparatus as set forth in claim 10, wherein:

said engaging means includes packing means which forms a seal with the wall of said well conduit.

18. The apparatus as set forth in claim 10, wherein:

said engaging means includes slip means which secure the apparatus to the wall of said well conduit.

19. A retrievable subsurface well conduit engaging apparatus comprising:

elongated support means for running into a well conduit to a selected depth;

engaging means mounted on said support means operable to releasably engage and seal against the wall of said well conduit;

operating means connectible with an actuating device comprising first and second cylindrical sleeves connected to said engaging means, said operating means being operable to selectively engage and release said engaging means from the wall of said well conduit;

locking means operatively connected between said support means and the first sleeve of said operating means to maintain said engaging means in engagement with the wall of said well conduit so that vertical forces acting on the second sleeve of said operating means are not imposed on the first sleeve of said operating means, thereby facilitating the release of said engaging means from the wall of said well conduit;

non-threaded coupling means comprising a plurality of radially movable release segments operatively connecting the second sleeve of said operating means to transmit vertical forces exerted against the second sleeve of said operating means to said locking means, thereby facilitating the release of said engaging means from the wall of said well conduit upon vertical, non-rotating movement of the second sleeve of said operating means.

* * * * *